US005930926A

United States Patent [19]

Kaplan

[11] Patent Number: 5,930,926

[45] Date of Patent: Aug. 3, 1999

[54] DISPLAY SIGN SYSTEM

[75] Inventor: Paul Kaplan, East Northport, N.Y.

[73] Assignee: International Patterns Incorporated, Bayshore, N.Y.

[21] Appl. No.: 08/868,901

[22] Filed: Jun. 4, 1997

[51] Int. Cl.[6] ..... G09F 7/02

[52] U.S. Cl. ..... 40/611; 40/124.4; 40/575

[58] Field of Search ..... 40/124.4, 575, 40/585, 611, 657, 661.11, 568, 618

[56] References Cited

U.S. PATENT DOCUMENTS

| | | | |
|---|---|---|---|
| 1,400,438 | 12/1921 | Jaquette . | |
| 1,644,742 | 10/1927 | Moynihan . | |
| 2,006,573 | 7/1935 | Isenhour | 40/611 |
| 2,167,974 | 8/1939 | Edwards | 40/618 X |
| 2,313,723 | 3/1943 | Adler | 40/618 |
| 2,430,646 | 11/1947 | Ownbey | 40/618 |
| 2,508,553 | 5/1950 | Wagner | 40/611 X |
| 2,822,632 | 2/1958 | Parker et al. | 40/611 |
| 3,121,966 | 2/1964 | Upton | 40/657 X |
| 3,742,633 | 7/1973 | Palm . | |
| 4,461,107 | 7/1984 | Grate | 40/576 |
| 4,497,125 | 2/1985 | Hutchinson | 40/657 |
| 4,977,698 | 12/1990 | Seggerson | 40/618 |

*Primary Examiner*—Joannne Silbermann
*Attorney, Agent, or Firm*—Schweitzer Cornman Gross & Bondell LLP

[57] ABSTRACT

A display sign and system having a plurality of support strips removably attached to a back panel where the support strips have channels in opposite sides thereof, where the channels and sign members disposed in the channels overlap one another, and where the outside walls of the support strips are coterminous with the bottom walls of the channels. The sign members engage the channels of adjacent support strips at an inclined angle. Display adapters sized to engage the channels provide support for pictorial displays parallel to the back panel. Arms depend from the support strips and extending to the adjacent support strip to block light from escaping the display sign. Rows of vertically-spaced holes in the back panel and corresponding hooks on the strips provide means for uniform and rapid assembly.

11 Claims, 5 Drawing Sheets

DISPLAY SIGN SYSTEM

FIELD OF THE INVENTION

This invention relates to display signs, and more particularly, to display signs which provide for the attachment of a number of interchangeable sign strips.

Background of the Invention

Display signs with interchangeable and re-arrangeable signs are commonly used in establishments such as restaurants, theaters and banks to convey information such as service or product names, prices, graphics, and photographs. The information is usually contained on sign strips (or individual letter segments) which are inserted into and supported by the display sign. Often, the display signs include a light source and a diffuser which direct light through the sign strips.

While these types of displays are an effective means of conveying information, they necessarily occupy a significant amount of space. Also, the space in which it is most effective to use such a display is often limited. Moreover, any space that is available is commonly at a premium.

An example of a prior art display sign is U.S. Pat. No. 4,977,698 to Seggerson which discloses a display sign having a number of vertically-spaced longitudinal ribs defining tracks or channels for supporting sign strips. The sign strips slide into the channels from the side and the channels overlap and engage the edges of the sign strips such that the edges of the strips are aligned with one another, separated by the rib. While this prior art device does provide for a plurality of interchangeable sign strips, the abutting relationship of the sign strips is inefficient because the space occupied by the gap between the edges of adjacent sign strips, and the space occupied by the channel overlapping the sign strips, are unused and wasted. Also, the ribs of this prior art device are fixed, thus limiting the flexibility of the display. Similar rib structures which support sign strips in an abutting fashion are disclosed by U.S. Pat. Nos. 1,644,742 to Moynihan, 3,742,633 to Palm and 4,461,107 to Grate.

Another example of a prior art display sign is U.S. Pat. No. 1,400,438 to Jaquette which discloses a display sign having a number of vertically-spaced support strips which are bent to form two channels, one facing upward and one facing downward. The channels support sign members which are mounted by inserting the top edge up into a downwardly-facing channel of one strip and then lowering the bottom edge into the upwardly-facing channel of the strip below. The downwardly-facing channels of this prior art device include an outside wall which extends substantially below the bottom of the upwardly-facing channel of the same strip. This extended outside wall is necessary to support the sign member, that is, to prevent the sign member from rotating out of the display once the sign member is lowered into the upwardly-facing channel. After insertion, there exists a relatively large gap between the upper edge of the sign member and the trough of the downwardly-facing channel. Similar to the prior art devices discussed above, the edges of the sign members of the Jaquette device are aligned and are separated, vertically, by a space.

While the Jaquette device does provide for the arrangement of sign strips in a closely-spaced fashion, the vertical space between the edges of adjacent sign strips remains unused, also the space occupied by the extended side wall of the downwardly-facing channel decreases the efficiency of the display sign. Moreover, as with the prior art devices discussed above, the space over which the channels overlap the sign strips is unused, further the ribs of this prior art device are fixed, all of which limit the efficiency and flexibility of the display.

What is desired, therefore, is a display device for a plurality of interchangeable sign strips which increases efficiency by minimizing the amount of unused space and which increases flexibility by providing strips which are not fixed in place.

SUMMARY OF THE INVENTION

Accordingly, it is an object of the invention to provide a display sign which minimizes the space required for support structure and which maximizes the area available for signage.

It is another object to provide a display sign of the above character with sign members which partially overlap one another to increase the amount of space available for signage.

It is yet another object to provide a display sign of the above character with a plurality of support strips having opposed and overlapping channels for receiving and supporting the sign members in an overlapping fashion.

It is a further object to provide a display sign of the above character wherein the lengths of the outside walls of the channel structures are minimized, thereby maximizing the space available for signage.

It is yet still another object to provide a display sign of the above character with a means to support two sign members (such as a photograph and a translucent cover) in an overlapping and parallel fashion between two adjacent support strips.

It is yet a further object to provide a display sign of the above character with a means to prevent light from escaping in a direction parallel to the support strips.

It is another object to provide a display sign of the above character with a means to efficiently attach the support strips in a plurality of predetermined positions, thereby facilitating uniform and rapid assembly.

The above objects are realized by the present display sign invention which includes a back panel, a plurality of support strips attached to the back panel, and sign members between the support strips, where the support strips have two channels in opposite sides thereof, where the channels and the sign members disposed in the channels overlap one another, and where the outside walls of the support strips are coterminous with the exterior surfaces of the bottom walls of the channels, thereby minimizing the space occupied by the support strips and maximizing the area available for signage.

The display sign also includes display adapters which allow two sign members (such as a photograph and a cover or diffuser) to be displayed in an overlapping and parallel fashion between two support strips. The display adapters include a flange on one side (for engaging a channel in a strip) and two parallel channels on the opposite side.

The support strips also include arms for blocking light from passing out of the display sign in a direction parallel to the sign members. The arms depend from the ends of the support strips and, following the contours of the support and the sign members, extend to the next adjacent strip.

To provide for uniform and rapid assembly, the display sign also includes a means to attach the support strips in a plurality of predetermined positions.

These and other objects and advantages of the present invention will become more readily apparent during the following detailed description taken in conjunction with the drawings herein, in which:

DETAILED DESCRIPTION OF THE DRAWINGS

Figure 1:
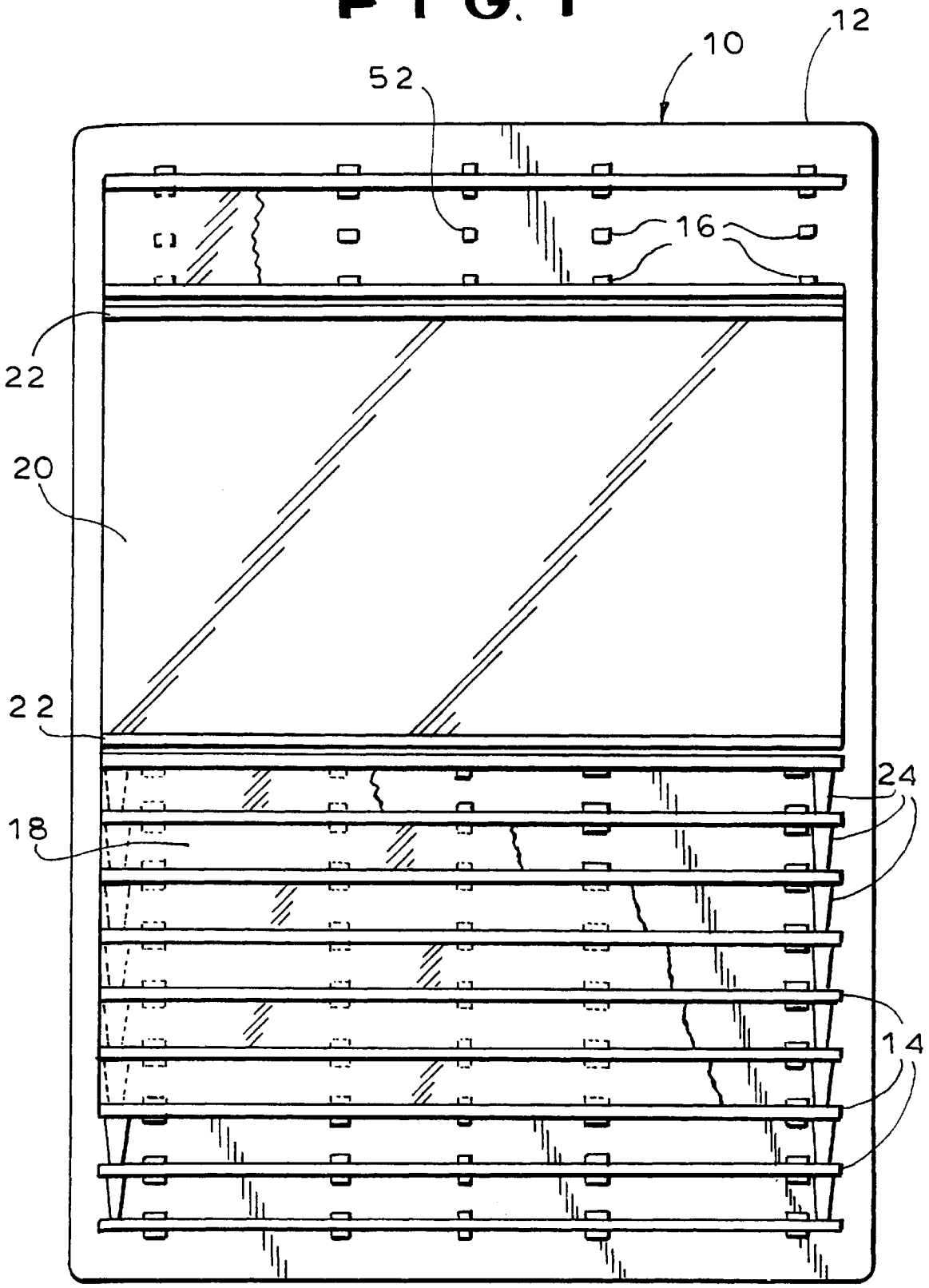
FIG. 1 is a front elevation view of the display sign of the present invention.

Referring to FIG. 1, a display sign 10 preferably includes a back panel 12 and a plurality of support strips 14 attached to back panel 12 by attachment means, such as the attachment holes 16 shown. Sign members 18 (e.g. menu strips) slide into channels (discussed below) in support strips 14. One or more pictorial displays 20, such as a photograph or graphic covered by a transparent cover, may be mounted between two support strips 14 via display adapters 22. Sign members 18 and pictorial displays 20 may be re-arranged if desired.

Preferably display sign 10 is back-lit to enhance the visibility of the information and displays. Thus, back panel 12 is preferably transparent or translucent to permit the passage of light therethrough. For example, back panel 12 may consist of a panel of injection-molded, high impact clear acrylic. Also, intermediate support strips 14 include arms 24 depending from the ends 26 thereof to prevent light from escaping from behind sign members 18. Other support strips 14 may not include such arms 24. Support strips 14 preferably consist of injection-molded ABS plastic, but may comprise any other suitable material.

Figure 2:
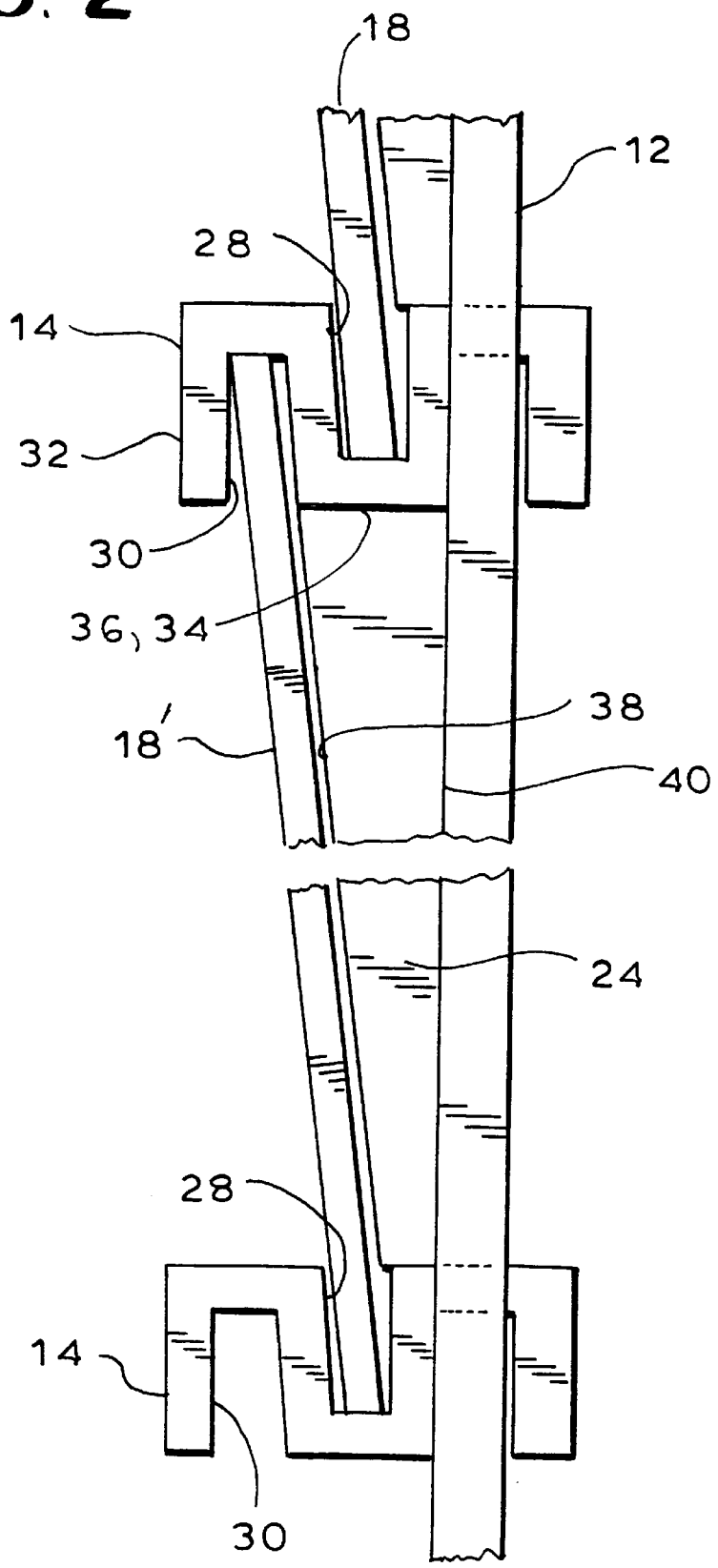
FIG. 2 is a view taken along line 2—2 of FIG. 1 illustrating the overlapping channels, the overlapping sign members, and the arm extending between adjacent support strips.

Referring to FIG. 2, support strip 14 includes an inside and an outside channel 28, 30 which open on opposite sides of support strip 14 and which overlap one another. Sign members 18, 18' disposed in channels 28, 30, also overlap, thereby eliminating the gap between adjacent sign members found in prior art devices. Also, the overlap increases efficiency further because a portion of the space required to support one sign member 18 is also used to support the adjacent sign member 18'.

The efficiency of display sign 10 is further increased by limiting the length of outside wall 32 of outside channel 30. Preferably outside wall 32 does not extend beyond the bottom wall 34 of inside channel 28. That is, preferably outside wall 32 ends at or before a plane which is tangent to the exterior surface 36 of bottom wall 34. This limits the space occupied by support structure and increases the area available for signage.

To confine the light passing through display sign 10, arm 24 depends from one support strip 14 and extends to the adjacent support strip 14'. Arm 24 includes edges 38, 40 which follow the contour of sign member 18' and back panel 12 thereby creating a light barrier to prevent light from escaping from display sign 10 in a direction parallel to sign members 18. One such arm 24 extends from each end of support strip 14.

Figure 3:
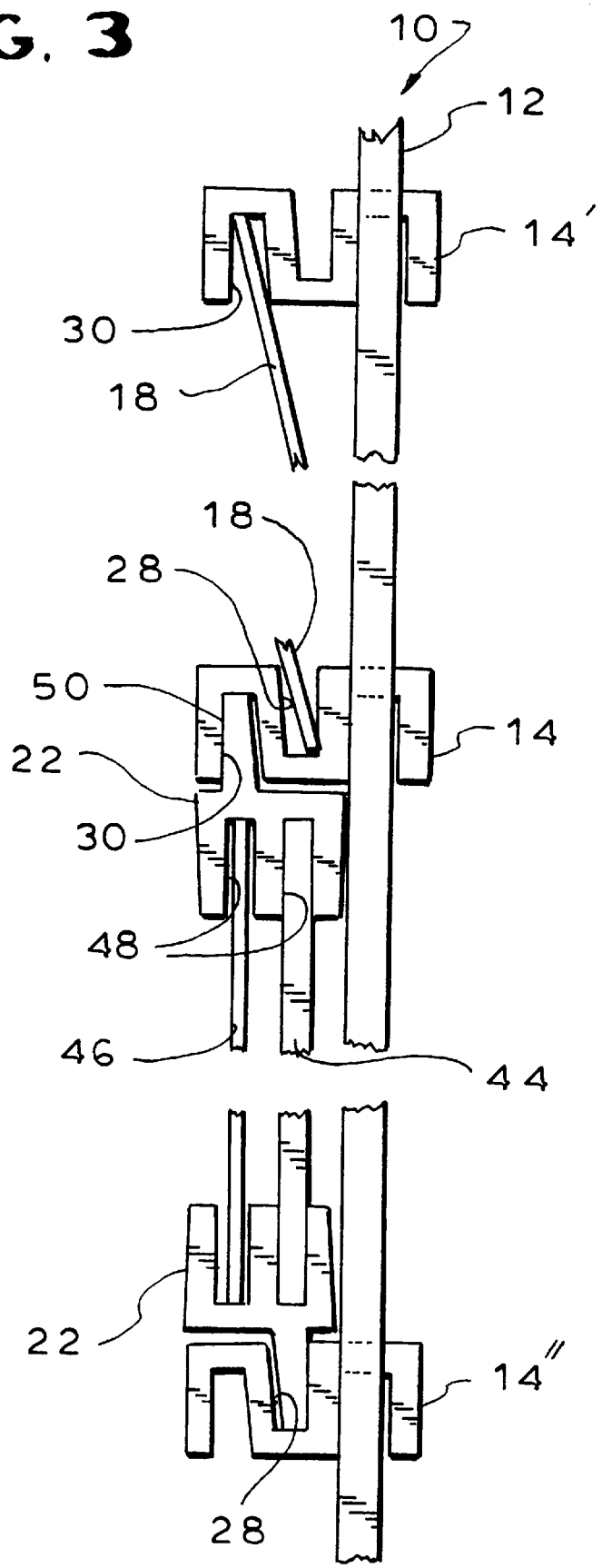
FIG. 3 is a view taken along line 3—3 of FIG. 1 illustrating two sign members supported between a pair of display adapters in a parallel and overlapping fashion.

Referring to FIG. 3, sign member 18 is preferably supported between an inside channel 28 of a lower support strip 14 and an outside channel 30 of an upper support strip 14' thereby giving sign member 18 a downwardly-facing incline as viewed from the front of the display. This incline helps to enhance the visibility of the display sign 10 when viewed from below.

A pair of display adapters 22 may be used to support a pictorial display 44 and a cover 46 between support strips 14, 14"; these support strips 14, 14" may not include arms 24. Display adapters 22 preferably include two parallel channels 48 in one side and a (preferably continuous) flange 50 on the opposite side. Flange 50 engages one of the channels 28, 30 of support strips 14, 14" and parallel channels 48 support pictorial display 44 and cover 46 in a parallel and overlapping manner. Flange 50 and parallel channels 48 are located such that the two display adapters 22 (when inserted in the inside and outside channels 28, 30 of adjacent support strips 14, 14") support the pictorial display 44 and cover 46 in positions substantially parallel to back panel 12. Optionally, if back panel 12 consists of a clear material, the panel closest to back panel 12 may be a diffuser and pictorial display 44 can occupy the outer channels of display adapters 22. Also, preferably, display adapters 22 are comprised of a clear material, such as clear acrylic or the like, thereby providing an unobstructed view of the entire pictorial display 44.

Referring again to FIG. 1, preferably the means to attach support strips 14 to back panel 12 include a plurality of vertically-spaced rows of holes 16 through back panel 12, and further include a plurality of center recesses 52 aligned with the rows 16. Also, preferably rows 16 are spaced at regular intervals to facilitate uniform assembly. However, any other suitable means, including without limitation mechanical, magnetic, hook-and-loop, or adhesive fasteners, may be used to attach support strips 14 to back panel 12.

Figure 4:
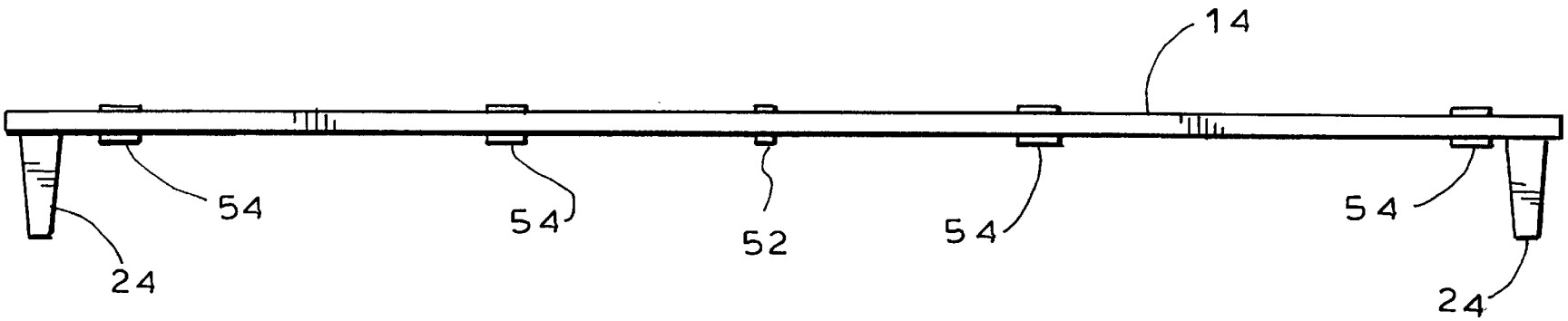
FIG. 4 is a front elevation view of a support strip of the present invention.
Figure 5:
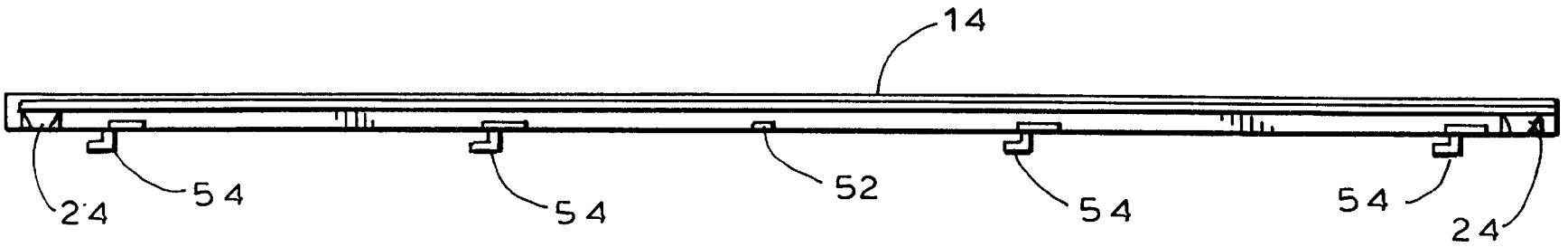
FIG. 5 is a bottom elevation view of the support strip of FIG. 5.
Figure 6:
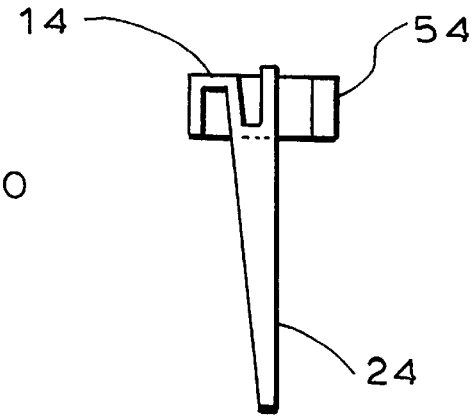
FIG. 6 is an end view of the support strip of FIG. 5.

Referring to FIGS. 4, 5 and 6, preferably support strip 14 includes a plurality of hooks 54 for engaging back panel 12 through holes 16. Also, preferably support strip 14 includes a locking notch 56 which engages recess 52 (See FIG. 1) to lock support strip 14 in place, and preferably, arms 24 are relatively wide for strength.

Figure 7:
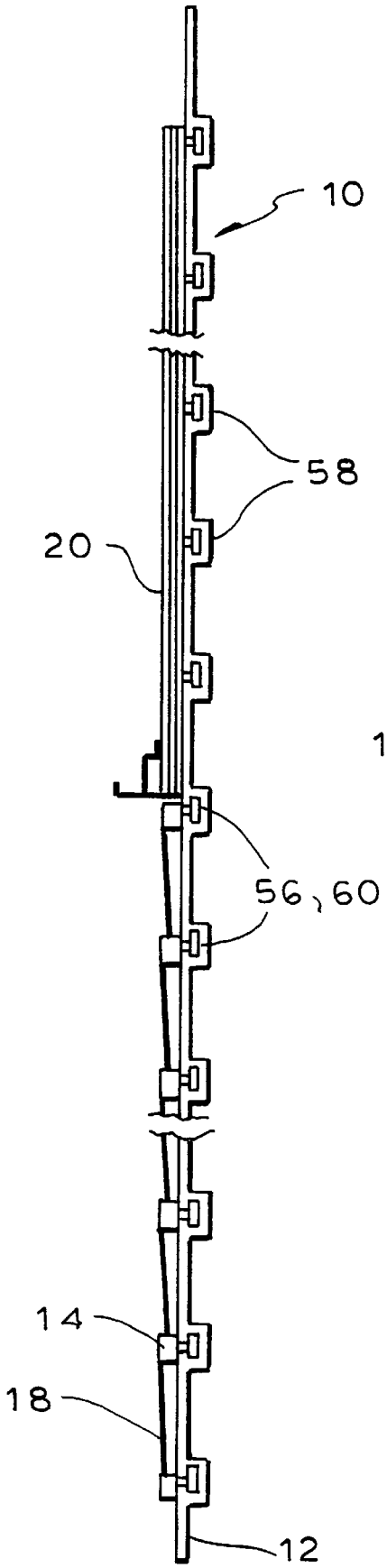
FIG. 7 is a side elevation view of another embodiment of the present invention illustrating another means by which to connect the support strips to the back panel.

Referring to FIG. 7, another means to secure support strips 14 to back panel 12 includes a plurality of T-shaped channels 58 formed in back panel 12 with corresponding T-shaped flanges 60 on support strips 14.

While it will be apparent to those skilled in the art that the preferred embodiment is well calculated to fulfill the above-stated objects and advantages, it will also be appreciated that the present invention is susceptible to modification, variation and alteration without departing from the scope and spirit of the claims as set forth below.

What is claimed is:

1. A display sign for displaying a plurality of removable sign members comprising:

a support;

a first strip secured to said support, said first strip having first and second channels in opposite sides thereof, a second strip secured to said support, said second strip having first and second channels in opposite sides thereof, said first and second strips each defining a center plane substantially parallel to said strip and substantially perpendicular said support, said center plane passing through both channels, a first sign member disposed in said first channel of said first strip and extending through said center plane of said first strip;

a second sign member disposed in said second channel of said first strip and extending through said center plane of said first strip such that said second sign member overlaps said first sign member thereby reducing the space required for support structure and increasing the area available for signage;

said second sign member being disposed in said first channel of said second strip and having an exposed area substantially greater than a total area covered by said first and second strips;

said first and second strips being attachable to said support in a plurality of locations to provide for various sign member sizes and configurations.

2. A display as in claim 1 wherein:

said first channel of said first strip is between said second channel thereof and said support, said channels of said first strip each further comprise a bottom wall with an exterior surface, said second channel of said first strip further comprises an outside wall, said first strip defines two side planes, each tangent to one of said exterior surfaces of said bottom walls and each perpendicular to said support, said outside wall of said second channel being between said two side planes thereby minimizing the space occupied by said first strip and maximizing the area available for signage.

3. A display as in claim 1:

said first strip further comprising two end portions; and further comprising two arms, one depending from each of said end portions of said first strip and extending to said second strip, each arm having an edge substantially parallel and adjacent to said support and having an edge substantially parallel and adjacent to said second sign member thereby substantially enclosing a volume defined by said arms, said first and second strips, said second sign member and said support to prevent light from passing out of said enclosed volume in a direction parallel said strips.

4. A display as in claim 3 wherein:

in said first strip, said first channel is between said second channel and said support, said second channel further comprises an outside wall and said first and second channels each further comprise a bottom wall with an exterior surface, and said first strip defines two side planes, each tangent to one of said exterior surfaces of said bottom walls and each perpendicular to said support, said outside wall of said second channel of said first strip being between said two side planes thereby minimizing the space occupied by said first strip and maximizing the area available for signage.

5. A display as in claim 4 wherein said first and second strips are substantially uniform and wherein said support further comprises means to secure said first and second strips to said support, said securing means providing a plurality of predetermined positions in which to secure said first and second strips thereby providing for uniform and rapid assembly.

6. A display as in claim 5 wherein:

said first and second strips further comprise back surfaces;

said support further comprises a panel having a back surface;

said means to secure said strips further comprises a plurality of vertically-spaced rows of holes in said panel, locking recesses in said panel aligned with said rows of holes, a plurality of hooks connected to said back surfaces of said first and second strips, and locking notches extending from said back surfaces of said first and second strips; and said hooks extend through said holes and engaging said back surface of said panel, and said locking notches extend into said recesses.

7. A display sign for displaying a plurality of removable sign members comprising:

a support;

a first strip secured to said support, said first strip having first and second channels in opposite sides thereof, said first strip defining a center plane substantially parallel said first strip and substantially perpendicular said support, said center plane passing through both channels, a first sign member disposed in said first channel and extending through said center plane;

a second sign member disposed in said second channel and extending through said center plane such that said second sign member overlaps said first sign member;

said first channel is between said second channel and said support, said channels each further comprise a bottom wall with an exterior surface, said second channel further comprises an outside wall, said first strip defines two side planes, each tangent to one of said exterior surfaces of said bottom walls and each perpendicular to said support, said outside wall of said second channel being between said two side planes thereby reducing the space required for support structure and increasing the area available for signage;

second and third strips secured to said support, said second and third strips each having first and second channels in configurations substantially similar to said first strip, first and second display adapters having a first side, a second side opposite said first side, a first channel formed in said first side, and a flange extending from said second side, said flange of said first display adapter being disposed in a channel of said second strip, said flange of said second display adapter being disposed in a channel of said third strip such that said channels of said first and second display adapters are open toward one another, and a pictorial display disposed in said first channels of said first and second display adapters.

8. A display as in claim 7 wherein:

said first display adapter further comprises a third side and a fourth side opposite said third side, said flange of said first display adapter being closer to said third side than to said fourth side; and said first display adapter further comprises a second channel formed in said first side, and said first and second display adapters are substantially uniform.

9. A display as in claim 8 wherein:

a plane aligned with said first channel of said first display adapter and said second channel of said second display adapter is substantially parallel to said support; and a plane aligned with said second channel of said first display adapter and said first channel of said second display adapter is substantially parallel to said support.

10. A display as in claim 9 wherein:

distances between said respective flanges and fourth sides of said first and second display adapters are substantially equal to a distance between said support and said second channel of said first strip; and distances between said respective flanges and third sides of said first and second display adapters are substantially equal to a distance between said support and said first channel of said second strip.

11. A display as in claim 10 further comprising:

said fourth side of said first display adapters being adjacent said support; and said third side of said second display adapters being adjacent said support.

* * * * *